US006770330B2

(12) United States Patent
Nagayama et al.

(10) Patent No.: US 6,770,330 B2
(45) Date of Patent: Aug. 3, 2004

(54) METHOD FOR PRODUCING A CONTINUOUS, LARGE-AREA PARTICLE FILM

(75) Inventors: Kuniaki Nagayama, Tokyo (JP); Antony Stanckev Dimitrov, Ibaraki (JP)

(73) Assignee: Research Development Corporation of Japan, Saitama (JP)

( * ) Notice: Subject to any disclaimer, the term of this patent is extended or adjusted under 35 U.S.C. 154(b) by 0 days.

(21) Appl. No.: 10/417,199

(22) Filed: Apr. 17, 2003

(65) Prior Publication Data

US 2003/0203103 A1 Oct. 30, 2003

Related U.S. Application Data

(63) Continuation of application No. 10/191,076, filed on Jul. 10, 2002, now abandoned, which is a continuation of application No. 09/947,341, filed on Sep. 7, 2001, now abandoned, which is a continuation of application No. 09/677,594, filed on Oct. 3, 2000, now abandoned, which is a continuation of application No. 08/841,587, filed on Apr. 30, 1997, now abandoned, which is a continuation of application No. 08/653,109, filed on May 24, 1996, now abandoned, which is a continuation of application No. 08/302,196, filed on Aug. 31, 1994, now abandoned.

(30) Foreign Application Priority Data

Aug. 31, 1993 (JP) ..... 1993/216663

(51) Int. Cl.[7] ..... B05D 1/18

(52) U.S. Cl. ..... 427/430.1; 427/372.2; 427/434.3; 427/434.5

(58) Field of Search ..... 427/372.2, 430.1, 427/434.3, 434.5; 118/402

(56) References Cited

U.S. PATENT DOCUMENTS

| | | | | |
|---|---|---|---|---|
| 3,526,536 | A | 9/1970 | Spengos et al. | 427/434.3 |
| 3,973,961 | A | 8/1976 | Stroszynski | 118/410 |
| 4,599,969 | A | 7/1986 | Barraud et al. | |
| 4,722,856 | A | 2/1988 | Albrecht et al. | |
| 4,779,562 | A | 10/1988 | Ono | |
| 4,801,476 | A | 1/1989 | Dunsmuir et al. | |
| 4,840,821 | A | 6/1989 | Miyazaki et al. | |
| 4,875,762 | A | 10/1989 | Kato et al. | |
| 5,250,320 | A | 10/1993 | Suzuki et al. | |

FOREIGN PATENT DOCUMENTS

| | | |
|---|---|---|
| JP | 60-193531 | 10/1985 |

*Primary Examiner*—Katherine A. Bareford
(74) *Attorney, Agent, or Firm*—Wenderoth, Lind & Ponack, LLP

(57) ABSTRACT

A method of forming a particle film on a surface of a solid or liquid substrate involves contacting the substrate, in the presence of a gas, with a liquid medium containing a plurality of particles suspended therein. A liquid meniscus is thereby formed between the substrate and the gas. An edge of the liquid meniscus is moved relative to the substrate, so that said particles in the liquid medium form the particle film on the surface of the substrate.

6 Claims, 16 Drawing Sheets

METHOD FOR PRODUCING A CONTINUOUS, LARGE-AREA PARTICLE FILM

This is a continuation Ser. No. 10/191,076, filed Jul. 10, 2002, now abandoned, which is a continuation of Ser. No. 09/947,341, filed Sep. 7, 2001, now abandoned, which is a continuation of Ser. No. 09/677,594, filed Oct. 3, 2000, now abandoned, which is a continuation of Ser. No. 08/841,587, filed Apr. 30, 1997, now abandoned, which is a continuation of Ser. No. 08/653,109, filed May 24, 1996, now abandoned, which is a continuation of Ser. No. 08/302,196, filed Aug. 31, 1994, now abandoned.

FIELD OF THE INVENTION

The present invention relates to a method for producing a particle film. More particularly, the present invention relates to a method for continuously producing a particle film and crystallized particle film comprising particles arranged in order in terms of crystallization which are useful in the areas of highly functional catalysts, sensors and transducers, various optical materials such as interference film, reflective film, reflection preventive film, 2-dimensional particle multi-lens, light adjusting film, color developing film, various electronic materials such as conductive film, electromagnetic shielding film, LSI (Large Scale Integration) board, semiconductor laser solid element and optical and magnetic recording medium, photographic material such as highly sensitive photographic paper, selective transmission film, molecular sieve and selective adsorption film.

BACKGROUND OF THE INVENTION

Thin film technologies for producing a single-, or a multi-layered particle film as one form of assembly at a high accuracy and efficiency wherein particles exert their intrinsic useful functions to the greatest extent possible have been conventionally used in the areas of highly functional catalysts, sensors and transducers, various optical materials such as interference film, reflective film, reflection preventive film, 2-dimensional particle multi-lens, light adjusting film, color developing film, various electronic materials such as conductive film, electromagnetic shielding film, LSI board, semiconductor laser solid element and optical and magnetic recording medium, photographic materials such as highly sensitive photographic paper, selective transmission film, molecular sieve and selective adsorption film. Further, new thin film technologies capable of giving new physical properties and functions not found in individual particles per se to two-dimensionally assembled particles are actively introduced in the above-said industrial areas.

A number of particle film production methods are currently studied, and a suitable one is selected according to the production environment. They include the solution system such as electrolytic precipitation, interface system such as LB (Langmuir-Blodgett) film, vacuum system such as deposition and CVD, and dispersion system such as coating and spin coat.

Of these methods, the dispersion methods such as producing particle film from a particle dispersion system such as emulsion and suspension by drying and solidification include the above-mentioned spin coat, coating, and dipping techniques. These are generally used as a practical method.

Actually, however, it is difficult for the dispersive thin film systems such as the above spin coat, coating and dipping techniques to control thickness, number of layers, and particle density of particle film at a high accuracy and simultaneously in the production of thin film.

For example, the spin coat method allows production of very thin particle film but it is very difficult to control particle density. The coating method realizes a high particle density but produces only very thick film.

This means that the conventional thin film production methods such as spin coat, coating, and dipping methods are unable to produce thin film comprising the marginal thickness of a single layer of particles and high quality and highly controlled thin film such as dense and uniform particle film and crystallized particle film. Further, it is impossible for the above conventional methods to produce a large amount of thin film continuously.

In view of these circumstances, the inventors of the present invention have previously proposed a thin film forming method to solve the above problems of the thin film production method of the dispersive thin film system.

This is a method to produce particle film and crystallized particle film by evaporating wetting film and is a method to form 2-dimensionally assembled, uniform and dense particle film.

In the above method to produce particle film by evaporating wetting film, particle film is formed in the manner described below, for example. In FIG. 17(*a*), fine particles (1) of 2R in diameter are immersed in a liquid film (2) whose thickness is h (2R<h) on a flat board (3). This liquid film (2) is then thinned to a thickness of 2R>h, as shown in FIG. 17(*b*). Two-dimensional self-assembly of fine particles (1) starts to form thin film of particles at this moment.

Two factors are working in the process of this two-dimensional assembly: lateral capillary force deriving from surface tension and the force generated by the flow of liquids as a result of evaporation of liquids at the wetting film. When these two forces are balanced, fine particles will be two-dimensionally assembled regularly and very quickly.

The inventors of the present invention have proposed some devices to produce stable wetting film. For example, in FIG. 18, the liquids in liquid film (2) containing particles (1) are evaporated to form thin wetting film on a flat board (3). Further, in FIG. 19, the liquids in the liquid film (2) containing particles (1) placed on a flat substrate (3) are removed by suction to form thin wetting film on said flat board (3). In FIG. 20, liquids containing particles (1) are dropped onto a substrate (3) comprising mercury, and thin wetting film is formed via wet spreading.

Although these devices have contributed very much to the basic analysis of two-dimensional assembly of particles taking place in wetting film, it is impossible to produce stable wetting film of a large area qualifying for industrial applications with the above devices. Further, it is difficult for these devices to continuously produce a large quantity of particle film because a practical method and means has not been established to supply particles to keep the process going.

Accordingly, a method to produce stable wetting film of a large area, control of the number of particle film layers, and a method to supply fine particles must be established to apply the particle film production method to an industrial scale, assisting in the production of a large quantity of particle film continuously.

SUMMARY OF THE INVENTION

The present invention was developed in consideration of the above circumstances and solves the problems in the conventional particle film production methods by providing a method for producing a large quantity of particle film continuously. Said method is characterized by the ability to produce stable wetting film of a large area, control the number of particle film layers and supply fine particles efficiently and accurately, allowing the new particle film production method through self-assembly of fine particles to be applied on an industrial scale.

With a view to solving these conventional problems, the present invention provides a novel method for producing a particle film by contacting a solid or liquid substrate with a particle dispersive suspension, and sweeping, spreading and moving the leading edge of a meniscus formed at the 3-phase contact line by atmospheric air or gas, substrate and suspension, thereby forming the particle film, wherein the particle density and the number of particle film layers are controlled by the traveling velocity of the leading edge of the meniscus, volume ratio of particles and liquid evaporation rate, using these as parameters.

More specifically, with the present invention, particle suspension is spread on a solid or liquid substrate, stable wetting film is formed near the 3-phase contact line at the leading edge of the meniscus formed by the substrate, suspension and air, and the particles are closely packed in said wetting film by the assembling force of the particles generated by the flow of the liquids and the lateral capillary force, in which process the 3-phase contact line is continuously swept under controlled conditions to continuously produce particle film in one direction.

DETAILED DESCRIPTION OF THE PRESENT INVENTION

The present invention allows the assembly and close packing of fine particles by the force generated by the flowing liquids in the wetting film (laminar flow force) and lateral capillary force at a practical level of scale and efficiency.

For the purpose of description of the present invention, crystallized particle film is defined as a type of particle film in which fine particles form thin film with crystalline regularity.

The mechanism of steady and initial growth of particle film and crystallized particle film in the present invention is described below, followed by the description of control of the number of film layers, a method to supply particles and the like which together contribute to the production of stable wetting film of a large area.

Steady Growth of Film

The inventors of the present invention have already publicized a two-dimensional radial growth model for the production of particle film using liquid flow [C. D. Dushkin, H. Yoshimura and K. Nagayama, Chem. Phys. Lett. 204, 455 (1993)]. However, control parameters for two-dimensional radial growth were not given in the closed form and, in particular, a method to control the number of film layers and the particle density was not clearly defined in the above 2-dimensional radial model.

In the present invention, it is possible to control the production of particle film by using as control parameters, 1) liquid evaporation rate, 2) volume ratio of particles and 3) traveling velocity of the leading edge of the meniscus.

Figure 1:
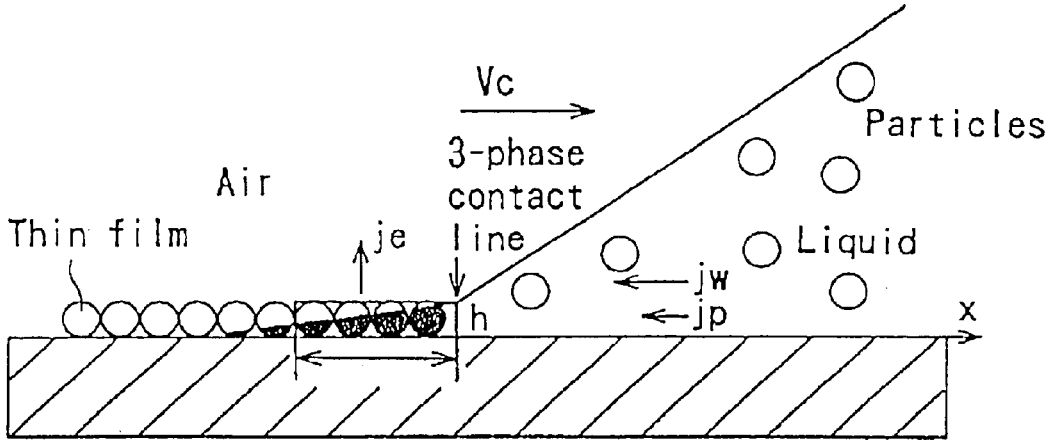
FIG. 1 depicts a growing thin film according to the principle of the present invention.

More specifically, in FIG. 1, for example, a crystallized particle film is formed on the left side of the 3-phase contact line at the leading edge of the meniscus and the particle film grows as the 3-phase line travels.

More specifically, the traveling velocity of the leading edge of the meniscus is the same as the film growing velocity in normal cases in the present invention. The parameter h in the figure is film thickness, Vc is the traveling velocity of the leading edge of the meniscus, l is the depth of evaporated crystalline region, je is the velocity of liquid evaporation, jw is the influx of liquids, and jp is the influx of particles.

It is important in the above thin film production process to balance the film growing velocity and the supply of particles.

Assuming occupied volume density (packing ratio) of particles to be $1-\epsilon$ ($\epsilon$: gap ratio), width of the evaporated crystalline region l, film thickness h, and volume ratio of particles $\phi$, then the film growing velocity ($V_c$) is given in the equation (1) below using control parameters of liquid evaporation velocity je, volume ratio of particles $$\varphi'\left(=\frac{\varphi}{1-\varphi}\right),$$

and traveling velocity $V_c$ of the leading edge of the meniscus.

$$(1-\varepsilon)h = Bl\frac{\varphi}{1-\varphi}je/Vc \equiv K \tag{1}$$

In the above equation (1), je is the liquid evaporation rate. Vc is the traveling velocity of the leading edge of the meniscus, and is the film growing velocity. The parameter B is a hydrodynamics coefficient indicating relative velocity of water to particles, and is about 1 in the absence of friction between particles and the substrate. The constant 1 in the above equation (1) is a value specific to the system, and is measurable. je, $\epsilon$, and Vc are control parameters. Packing coefficient K is known when these control parameters are known, and eventually shows the performance of the particle film. In the present invention, film thickness h assumes a discrete value $h_k$, depending on the particle system, in accordance with the number of film layers, 1, 2, 3, and so on. This is because of the strong packing generated by the lateral capillary force.

$$h_k = d + (k-1)H,\ k = 1, 2, \ldots \tag{2}$$

$$H = \begin{cases} d\sqrt{\frac{2}{3}} & \text{: hexagonal closet packing} \\ \frac{d}{\sqrt{2}} & \text{: square closet packing} \end{cases} \tag{3}$$

In the above equations, k is the number of film layers, and d the diameter of a particle.

$h_k$ means that h is a discrete value. H indicates how the thickness increases as the number of film layers increases. It can be one of several values (equation 3) depending on how the layers are stacked for packing (a lattice form).

Packing coefficient K on the right side in equation (1) is an externally controlled quantity, and determines the film thickness h and packing ratio $1-\epsilon$. Substituting $K=(1-\epsilon)h$ for $h_k$, we obtain K in equation (4) below.

$$K = (1-\epsilon)h_k \tag{4}$$

Equation (4) as it is indicates that the gap ratio $\epsilon$ and h may occur in any combination, but in the present invention the particles tend to achieve the closest packing owing to the lateral capillary force. In this case, the value of $\epsilon$ is such that k (the index of $h_k$) has the minimum value and $(1-\epsilon)$ has the maximum. It goes without saying that the value of $(1-\epsilon)$ does not exceed the closest packing ratio of 0.6.

Figure 2:
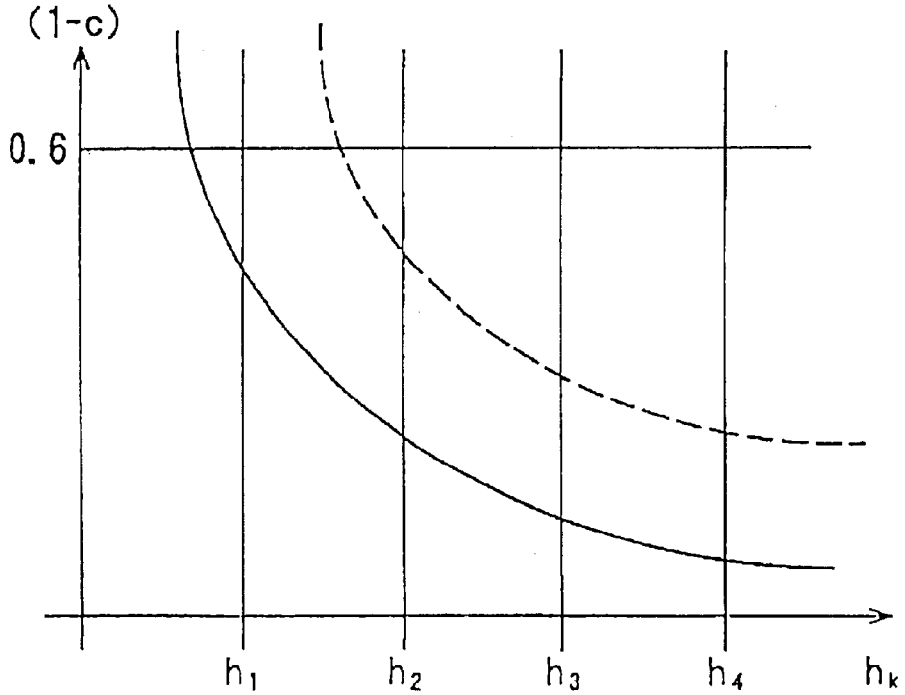
FIG. 2 illustrates the relationship between packing ratio $1-\epsilon$ and film thickness $h_k$.

When K is given as a production requirement, four different film thicknesses (number of layers) are possible for example, as shown in FIG. 2 by solid lines. However, according to the principle that the packing ratio $(1-\epsilon)$ is always to be maximized, k=1 is realized and as a result, we obtain single-layered high density film.

Cases shown by dashed lines in FIG. 2 are also possible depending on the value of K. In these cases, 2-layered film is produced as the closest packing.

Initial Growth of Particle Film

Control of initial growth and nucleus assembly is very important for all events occurring in the growth and assembly of a particle film. Control of initial growth affects the growth of thin film after the initial growth, determining the quality of film formation and assembly. We have established important control items through the analysis of growth of initial film (nucleus) in the wetting film evaporation method. According to the results of the experiments, generally speaking, wetting film tends to maintain a certain thickness depending on the nature of the liquids and the substrate used. This is determined by pressure balance expressed in equation (5) below.

$$P_g = \pi(h) + P_l - \rho gz \tag{5}$$

The left side of equation (5) is air pressure Pg. The first term on the right side is separation pressure $\pi(h)$ in the liquid film, and is dependent on the electrostatic repelling force between the substrate and the liquid as well as Van der Waals attraction.

Figure 3:
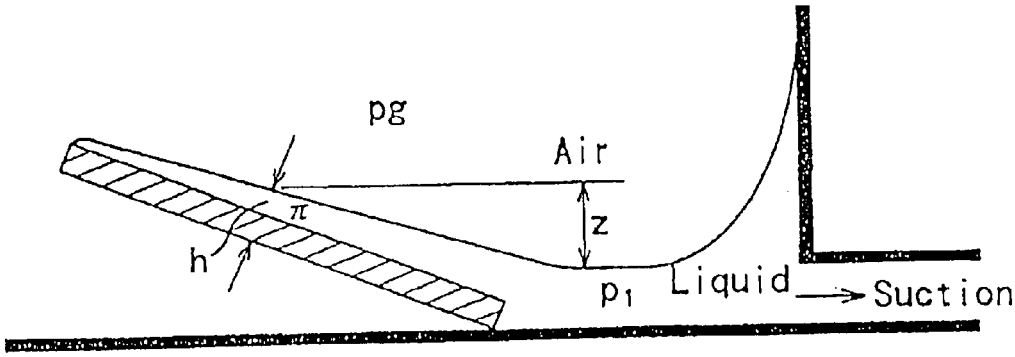
FIG. 3 shows a general side sectional view illustrating an aspect of the present invention.

With regard to the first term in equation (5), FIG. 3 shows the relation among separation pressure $\pi(h)$ in the wetting film on the inclined substrate, film thickness h, and height z. Separation pressure $\pi(h)$ is generally given in equation (6) as a function of film thickness h.

$$\pi(h) = 64C_{el}RT\gamma^2 e^{-Kh} - \frac{A}{6\pi h^3} \tag{6}$$

In the above equation, $C_{cl}$ is the concentration of the electrolyte, $\gamma$ is surface pressure, K is a Debye-Hückel parameter, R is the gas constant, T is temperature, and A is a Hamaker constant (a positive number in most cases).

The second term $P_l$ on the right side in equation (5) is pressure in the liquid immediately below the bottom of the meniscus (generally $P_g - P_l > 0$ because the meniscus has a right side), $\rho gz$ is hydrostatic pressure measured at the lowest part of the meniscus ($\rho$: liquid density; g: gravitational acceleration).

In equation (5), only separation pressure $\pi(h)$ depends on h. Other parameters can be set externally irrelevant of h. Accordingly, equation (5) may be re-arranged as equation (7) and can be solved easily using a graph in FIG. 4. The right side of equation (7) is generally called capillary pressure.

$$\pi(h) = P_g - P_l + \rho gz \tag{7}$$

Figure 4:
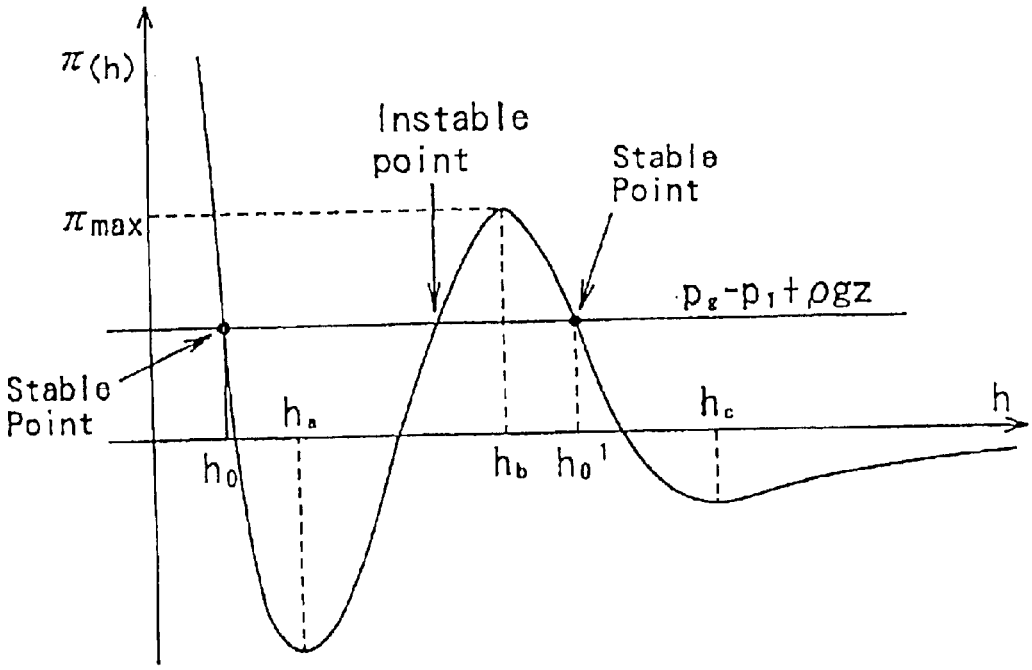
FIG. 4 shows an outline depicting the relationship between separation pressure $\pi(h)$ and the thickness h of wetting film.

It is known from the graph in FIG. 4 that there are generally three or more film thicknesses that satisfy equation (7). Of these film thicknesses, those in the $h_a < h < h_b$, and $h_c < h$ range are unstable and do not produce film of stable thickness. Instead, thin film formation inevitably goes on in the direction of $h_a$ or $h_c$. Stable film thickness is realized at intersections $h_o$ or $h'_o$ on the rising curve.

Film thickness is found on $h_o$ when capillary pressure $P_g - P_l + \rho gz$ is above $\pi_{max}$, and on two points of $h_o$ and $h'_o$, when it is below $\pi_{max}$. This means that a high capillary pressure always helps production of very thin wetting film, and an adequate level of capillary pressure helps production of thick wetting film of $h'_o$.

Figure 5A:
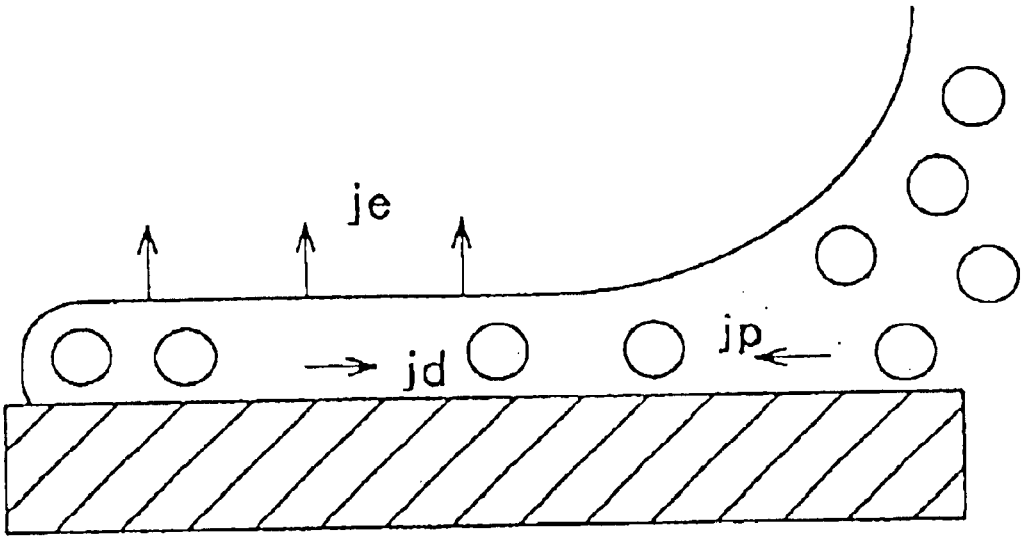
FIGS. 5A and 5B show side views illustrating aspects of the present invention.
Figure 5B:
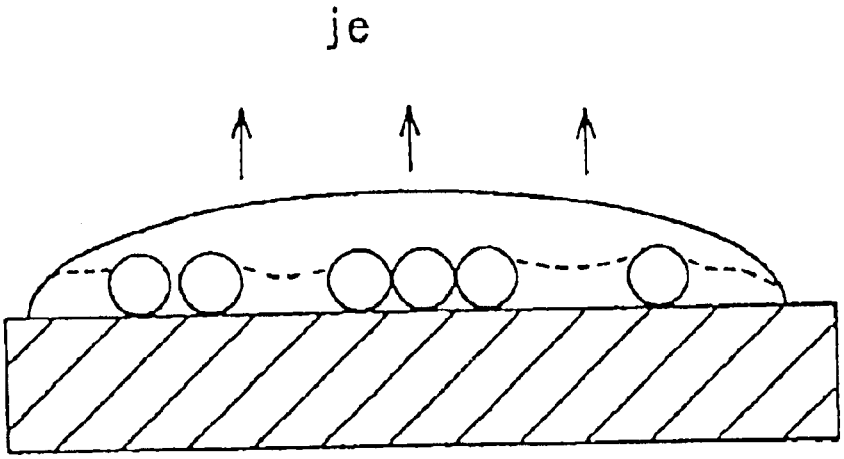

Stable film thickness $h_o$ and $h'_o$ are important for the initial growth for the following reasons. As shown in FIG. 5, for example, if the thickness of the wetting film is greater than the particle system, and if, as shown in FIG. 6, for example, the thickness of the wetting film is smaller than the particle system, the following description applies.

First, if the wetting film is thick as shown in FIG. 5, particles are carried by the liquid flow and are stuck in the direction of the wetting film. Balance is achieved between the particles and the reverse liquid flow due to dispersion because a large concentration gradient is formed on the boundary between the wetting film and the meniscus. Thus, particles are not assembled beyond a certain concentration. Further, the particles are fully submerged so that the lateral capillary force does not work, and hence crystallized particle film is not formed.

If the leading edge of the meniscus is swept in this state, the wetting film is left behind (ruptured) as shown in FIG. 5(*b*), and solidification through evaporation takes place while the particle concentration is low, causing partial assembly.

Figure 6A:
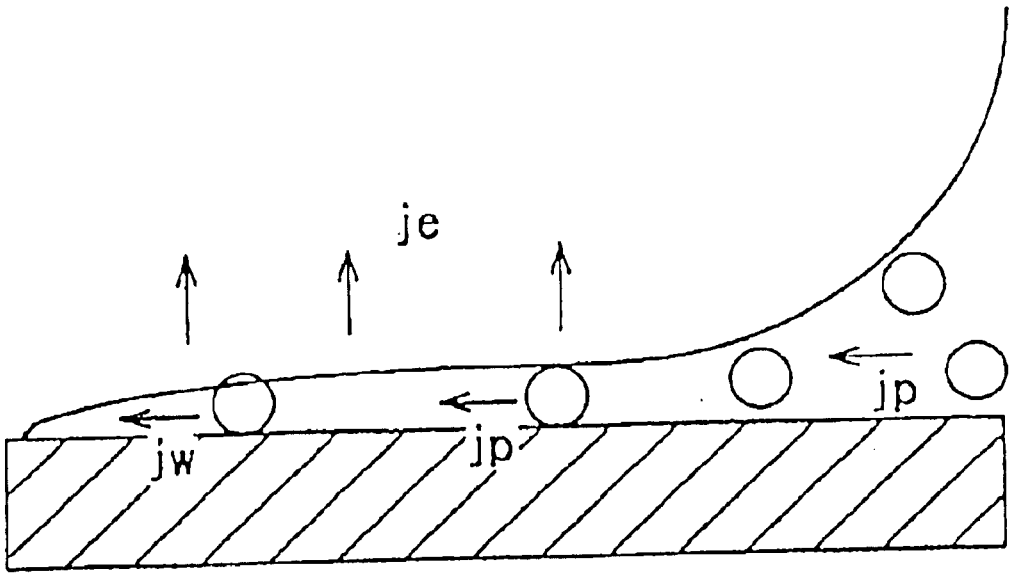
FIGS. 6A and 6B show side views illustrating the methodical principle of the present invention.
Figure 6B:
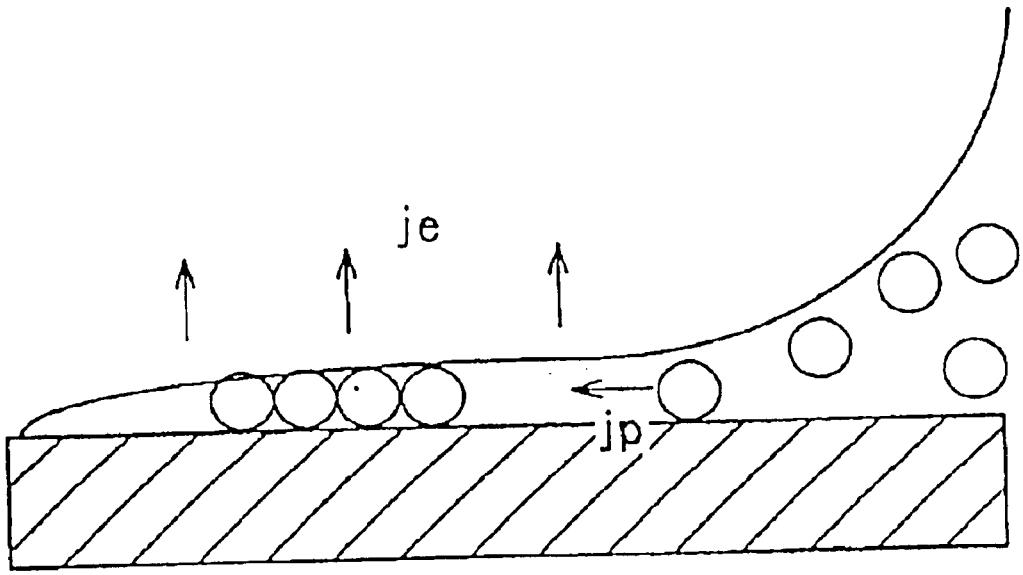

If on the other hand thickness of the wetting film is approximately the same as the diameter of particles as shown in FIG. 6(*a*), the influxed particles are partly trapped by the vertical capillary force. Reverse flow is prevented in this case, and thus sequential assembly of particles takes place with the trapped particles serving as the first nucleus for film formation as shown in FIG. 6(*b*). Once a nucleus of an appropriate size is formed near the boundary between the wetting film and the meniscus, single-, double- and triple-layered dense crystallized particle film and thin particle film are controlled and produced by the balance between the particle influx velocity and the traveling velocity of the 3-phase contact line of the leading edge of the meniscus described with reference to steady growth in the previous section.

It is necessary to control the thickness of wetting film as described above, and generate a dense nucleus for film formation in order to produce dense particle film and crystallized particle film.

As is clear from the above description, in order to make the thickness of the wetting film approximately the same as particle size, there are two possible cases: rearrangement of the right side of equation (7) and rearrangement of the left side of equation (7) or parameters in equation (6). The following control items are considered when rearranging the right side of equation (7):

<a> Change the curvature of the meniscus to change the size of $P_g - P_l$.
<b> Change $P_g - P_l$ by suction.
<c> When a solid substrate is used, change height z by tilting the substrate to change h continuously.

With the above methods, it is possible to change stable thin film within the range of $h<h_a$ and $h_b<h<h_c$ when the curve for separation pressure $\pi(h)$ is already established.

However, when the particle size is not within this range, separation pressure $\pi(h)$ itself must be changed.

Further, the following control items are considered when rearranging the left side of equation (7) or the parameters in equation (6).

<d> Change pH or salt concentration to change $C_{cl}$ and K.
<e> Change $\gamma$ by using surfactant.
<f> Change the substrate to change Hamaker constant A.

These control items are adjusted and the thickness of the wetting film is adjusted to approximately the size of the particle system.

With regard to the above methods and control, various embodiments are possible to move the 3-phase contact line on the leading edge of the meniscus.

Figure 7A:
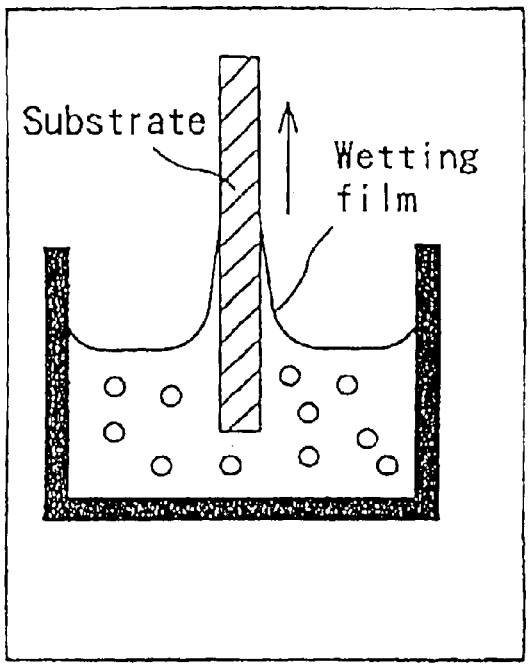
FIGS. 7A and 7B illustrate further aspects of the present inventive method.
Figure 7B:
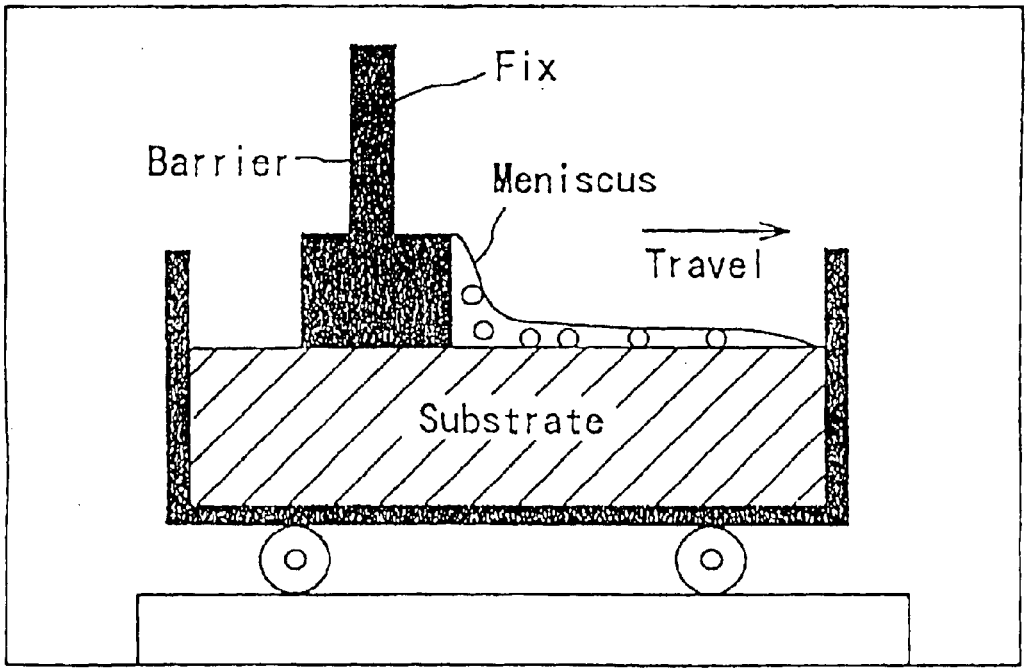
Figure 8A:
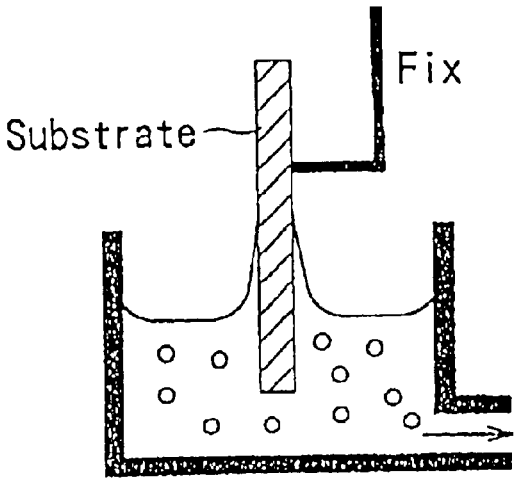
FIGS. 8A, 8B and 8C depicts additional aspects of the present inventive method.
Figure 8B:
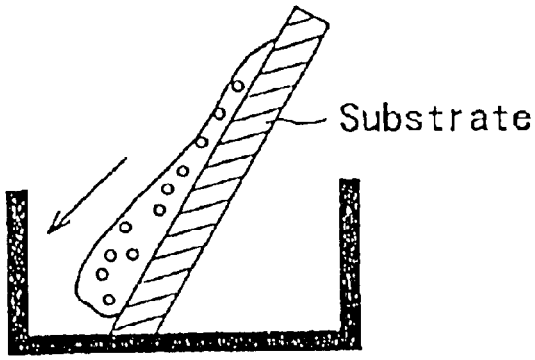
Figure 8C:
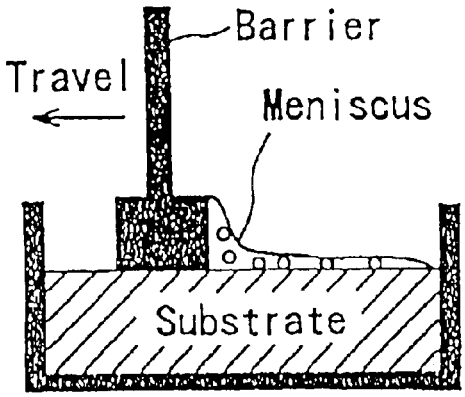

Broadly speaking, there are two methods; one is to move the substrate itself (FIG. 7), and the other to move the particle suspension (FIG. 8).

The former is further divided into a method to slowly lift the solid substrate from the particle suspension thereby moving the 3-phase contact line as shown in FIG. 7(*a*), and a method to wet the barrier walls to form a meniscus and then move the substrate in the horizontal direction to move the 3-phase contact line as shown in FIG. 7(*b*).

The method to move the particle suspension can be performed in three ways: <A> a method wherein as shown in FIG. 8(*a*) for example, the solid substrate immersed in the suspension is fixed externally, and the surface of the suspension is brought down by suction, thereby moving the 3-phase contact line, <B> a method wherein as shown in FIG. 8(*b*) the suspension flows slowly over the tilted substrate from top thereby moving the 3-phase contact line, and <C> a method wherein as shown in FIG. 8(*c*) for example, a barrier on a liquid (solid) substrate is slowly swept in order to move the 3-phase contact line.

Method to Supply Particles

Particles are supplied from the suspension meniscus side in the present invention. The suspension is consumed while the concentration (volume ratio) is kept constant because liquid influx (jw) and particles influx (jp) as a result of evaporation take place simultaneously. A suspension reservoir is necessary to supply suspension.

It goes without saying that decreased suspension is not a problem if the substrate is immersed in a sufficient amount of suspension in the lifting or lowering method shown in FIGS. 7(*a*) and 8(*a*).

Further, the method to slowly flow suspension over a tilted substrate from top to bottom in order to move the 3-phase contact line as shown in FIG. 8(*b*) is not suitable for large-lot continuous production of crystallized particle film because it is difficult to continuously supply particles.

The method shown in FIG. 7(*b*) to wet the barrier walls to form meniscus, and slowly move the substrate in the horizontal direction in order to move the 3-phase contact line, and the method shown in FIG. 8(*c*) to slowly sweep the barrier on a liquid (solid) substrate in order to move the 3-phase contact line are both indispensable methods particularly when using a liquid substrate, and it is necessary to develop a particle supply method.

Figure 9:
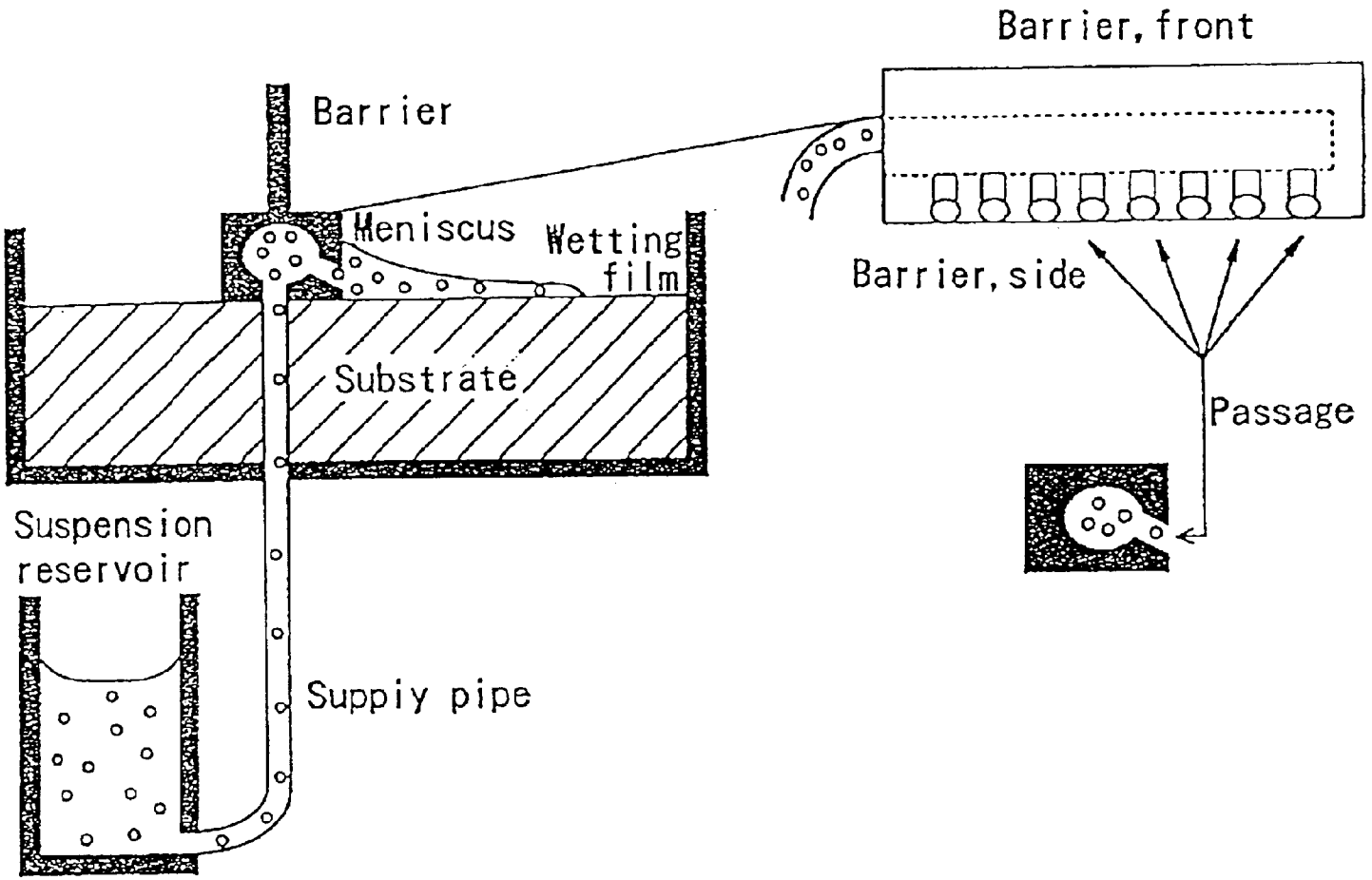
FIG. 9 shows a side view of an exemplary method according to the present invention.

More specifically, one embodiment of a suspension supply method which can be applied to the methods shown in the above-mentioned FIGS. 7(*b*) and 8(*c*) is shown in FIG. 9 as an example.

This suspension supply method is able to control capillary pressure at the meniscus by continuously supplying suspension from the suspension reservoir via pipes.

Figure 10:
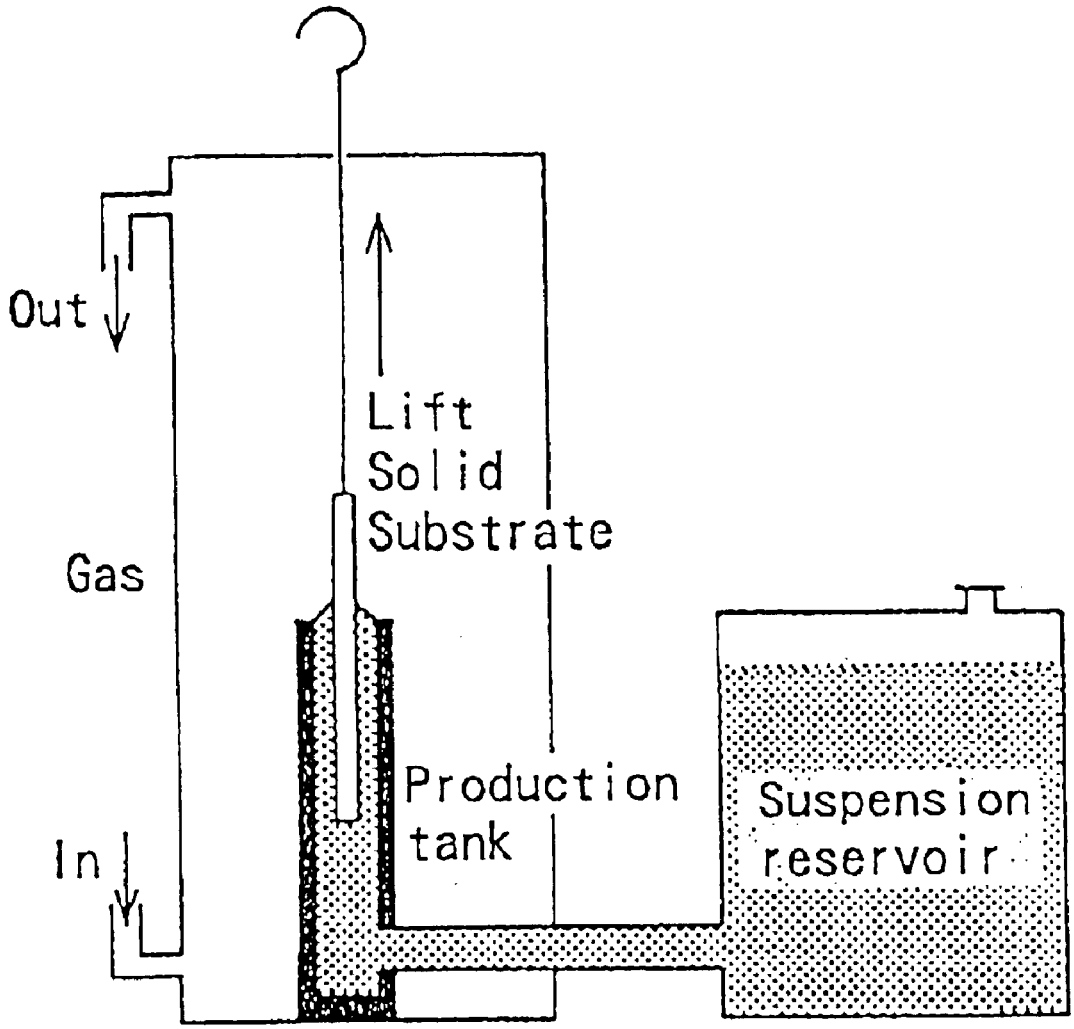
FIG. 10 shows a side view exemplifying a preferred method according to the present invention.

Another suspension supply method shown in FIG. 10 as an embodiment, for example, can be used for the lifting and lowering methods shown in FIGS. 7(*a*) and 8(*a*), respectively.

In the suspension supply method shown in FIG. 10, film is formed in the production tank and suspension is supplied from the reservoir via pipes.

If in the present invention the particles and the substrate repel each other, the solid substrate in the lifting method in FIG. 7(*a*) and in the lowering method in FIG. 8(*a*) may be tilted as shown in FIG. 8(*b*). In this way, crystallization repelling particles settle on the solid substrate facilitating particle film formation.

When particle film is to be formed only on one side of a solid substrate, the walls of the suspension reservoir may be used as a solid substrate. It is preferable in this case to use the suspension lowering method in FIG. 8(*b*).

When both sides of a solid substrate are to be coated with two different types of particles, one on each side, it is preferable to fill different types of suspension on the right and left side of the suspension tank.

Generally, atmospheric air, liquids and solids (liquids) are the three phases which are present on the 3-phase contact area at the leading edge of the meniscus, but these may instead be general gases (liquids), liquids and solids (liquids).

Further, the entire crystallized film growth region may be covered when necessary to keep it clean. It is then easier to control gas flow, temperature and humidity.

The method to continuously produce a large quantity of particle film and crystallized particle film according to the present invention is described below in more detail.

EXAMPLE 1

Thin film was produced from fine particles of monodisperse polystyrene latex balls of 0.814±23 μm (density: 1.065) using a simplified version of the method to sweep the leading edge of the meniscus shown in FIG. 8(*b*).

A drop of particle suspension (50 μl) was put on a pane of clean glass. The drop spread to an area of about 6 $cm^2$.

Figure 11:
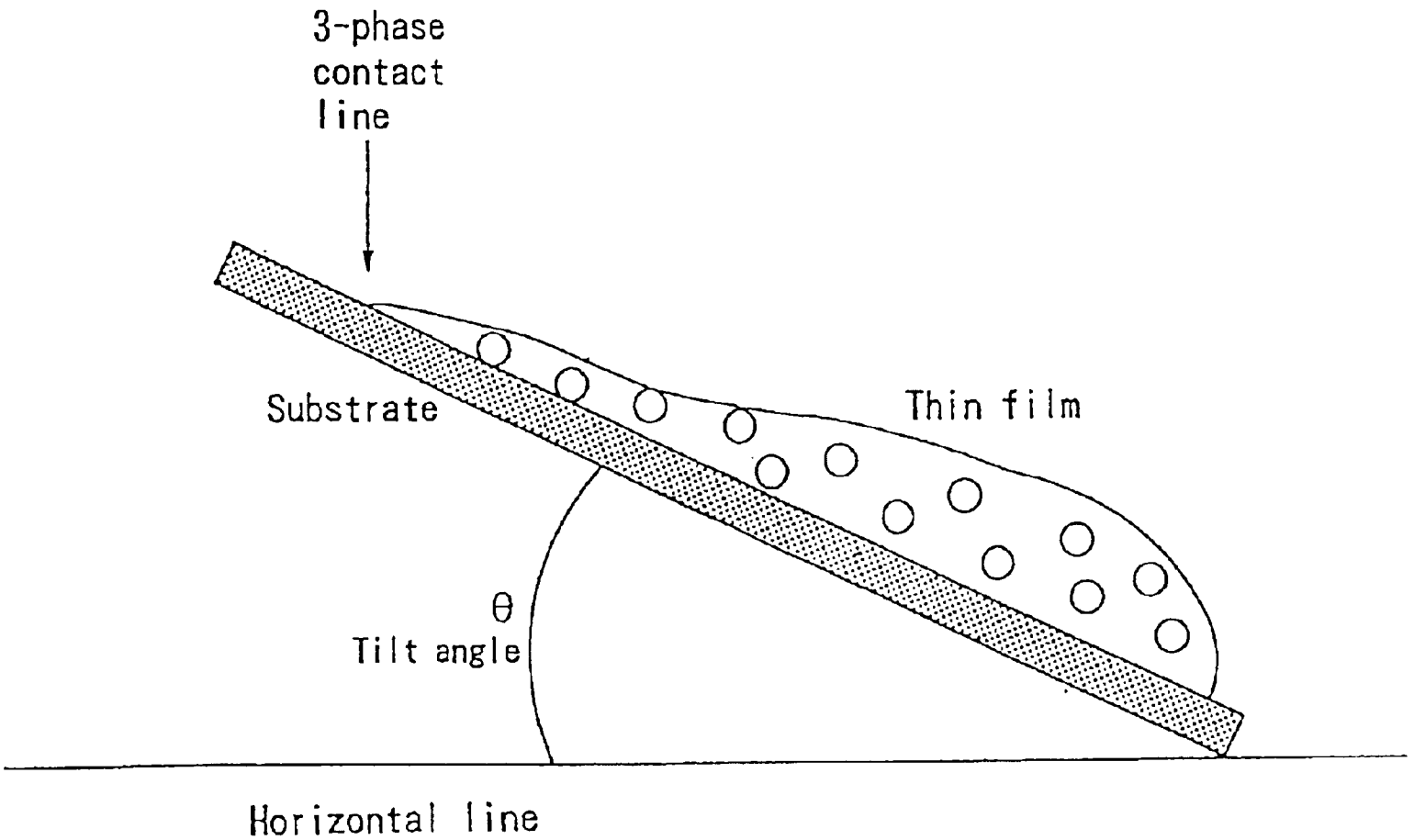
FIG. 11 shows a side view exemplifying an embodiment of the present invention.

The angle of inclination (θ) was adjusted as shown in FIG. 11 to control Vc (spread velocity for the leading edge of the meniscus or film growing velocity) in equation (1).

Evaporation velocity was kept constant in the experiment room which was controlled at 25° C. and 48% humidity. Volume ratio of 0.01 was used for the particles. The liquids run slowly down the glass surface to form particle film from the top downward.

Figure 12:
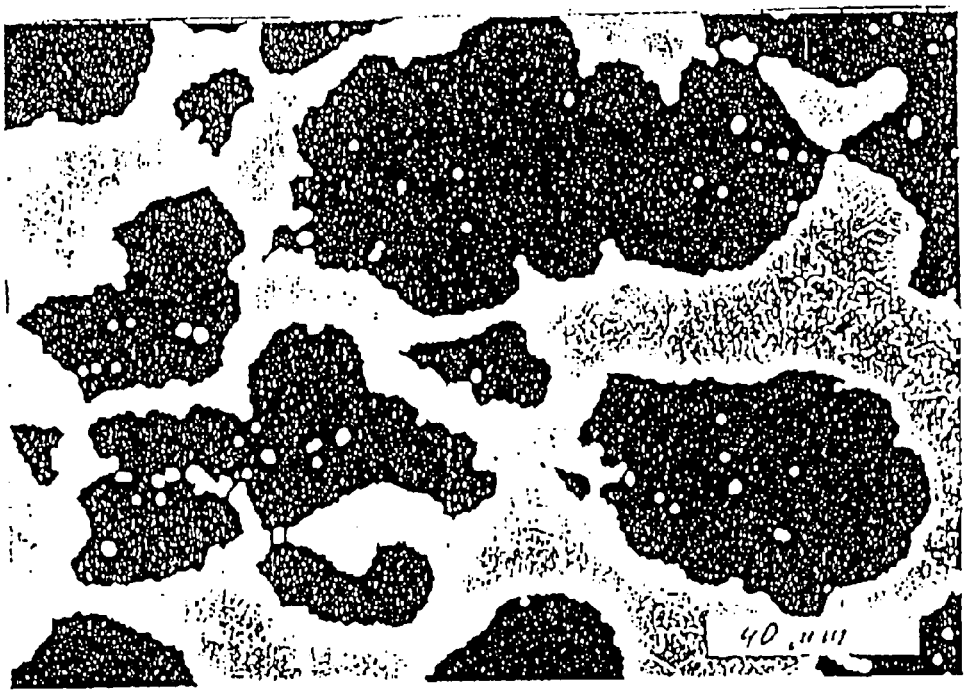
FIG. 12 shows a photograph as an embodiment of the present invention.
Figure 13:
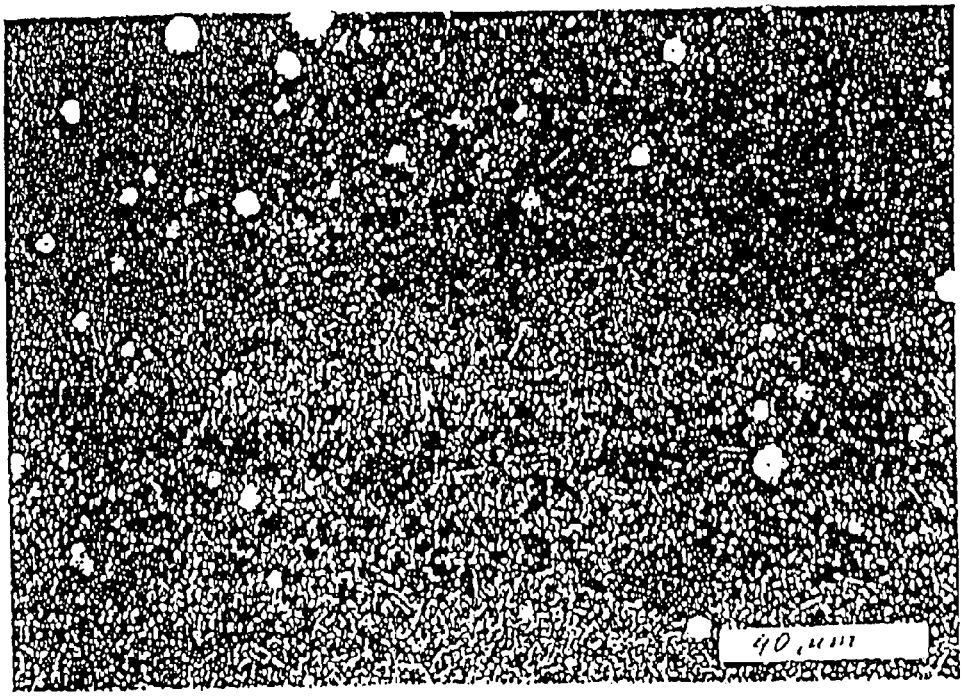
FIG. 13 shows a photograph as an embodiment of the present invention.
Figure 14:
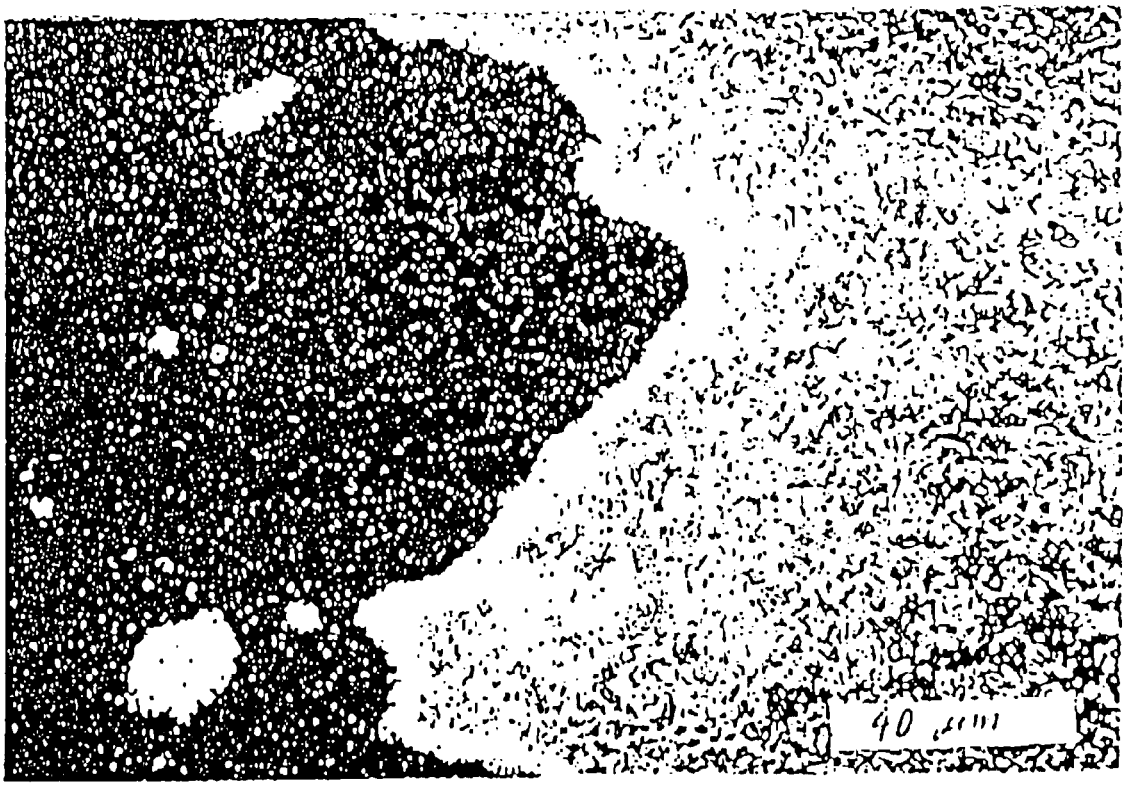
FIG. 14 shows a photograph as an embodiment of the present invention.

FIGS. 12 through 14 are photographs showing formation of thin film for various spreading velocity of the leading edge of the meniscus.

A dense single particle layer was formed for Vc=10 μm/s as shown in FIG. 13.

As shown in FIG. 12, when the spreading velocity of the leading edge of the meniscus Vc was 30 μm/s, or greater than 10 μm/s in the above case, packing coefficient K was smaller and the packing ratio (1−ϵ) was reduced. The particles were locally solidified due to assembly under the effect of the above-mentioned lateral, capillary force, and completely void areas were produced, with the result that the packing ratio was reduced-as a whole. The packing ratio was reduced to one-third because the spreading velocity was increased to three times that for the complete single layered particle film.

When the spreading velocity Vc of the leading edge of the meniscus was reduced from 10 to 9 m/s, a jump occurred from $h_1$ one layer to $h_2$ 2 layers as the packing ratio (1−ϵ) exceeded the closest packing of 0.6 as shown in FIG. 14.

EXAMPLE 2

Thin film similar to that in the above embodiment was formed from fine particles of monodisperse polystyrene latex balls of 0.144±2 μm (density: 1.065).

A drop of particle suspension was placed on a pane of clean glass. It spread to an area of about 8 $cm^2$.

Angle of inclination θ was adjusted. As in embodiment 1 spreading velocity Vc of the 3-phase contact line of the meniscus was varied to form crystallized particle film. The film formation under the optimum condition of Vc=10 μm/s is shown in FIG. 15.

Figure 16:
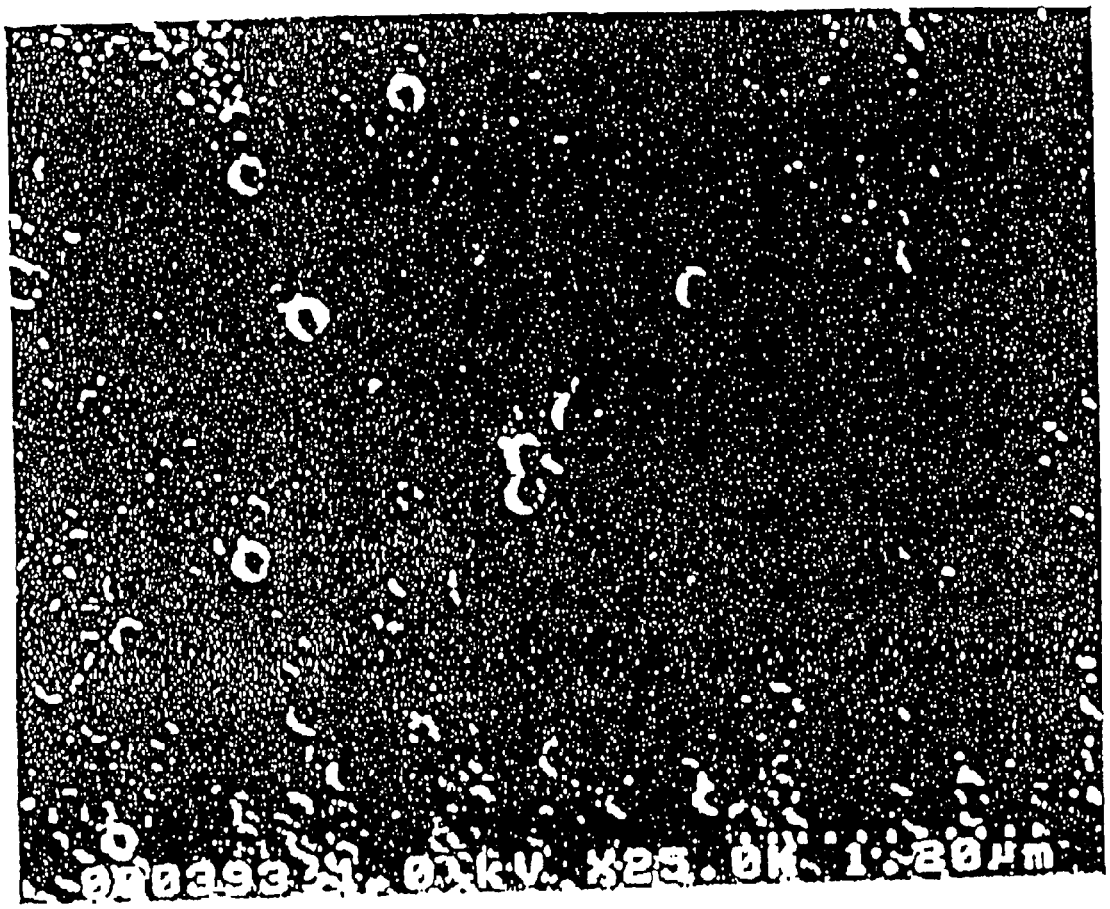
FIG. 16 shows a photograph as an embodiment of the present invention.
Figure 17A:
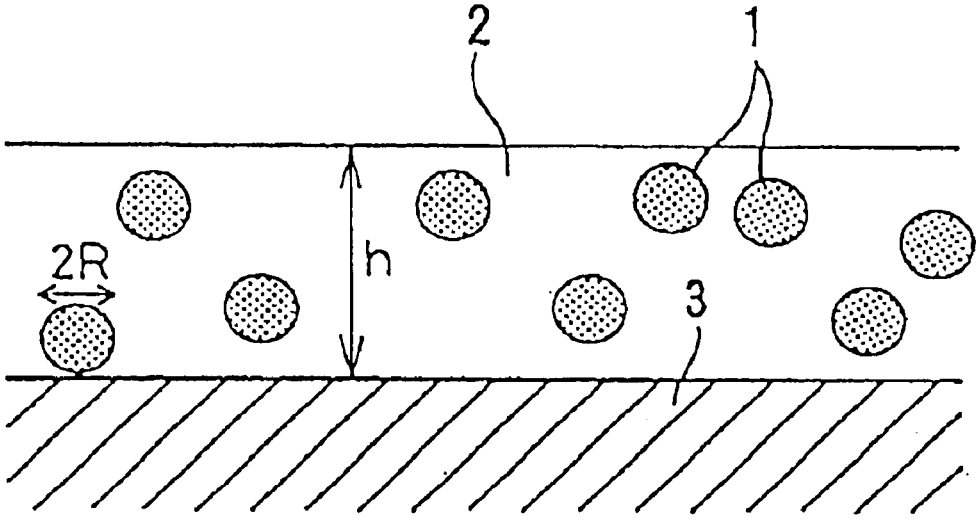
FIGS. 17A and 17B show an outline drawing illustrating the thin film generation method of the present invention.
Figure 17B:
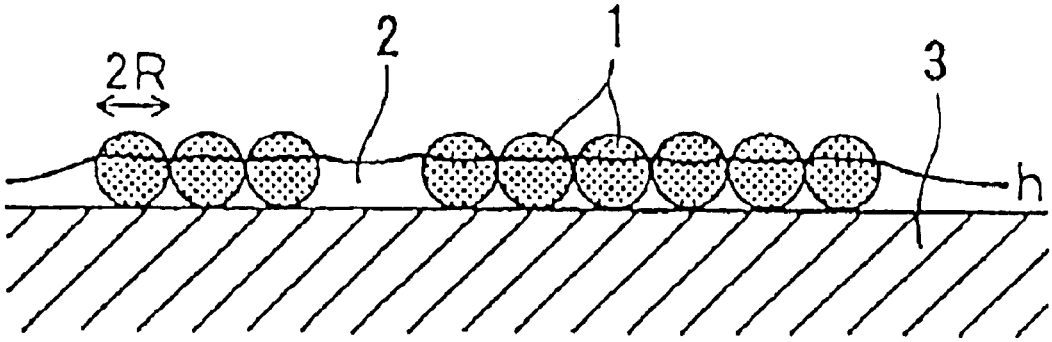
Figure 18:
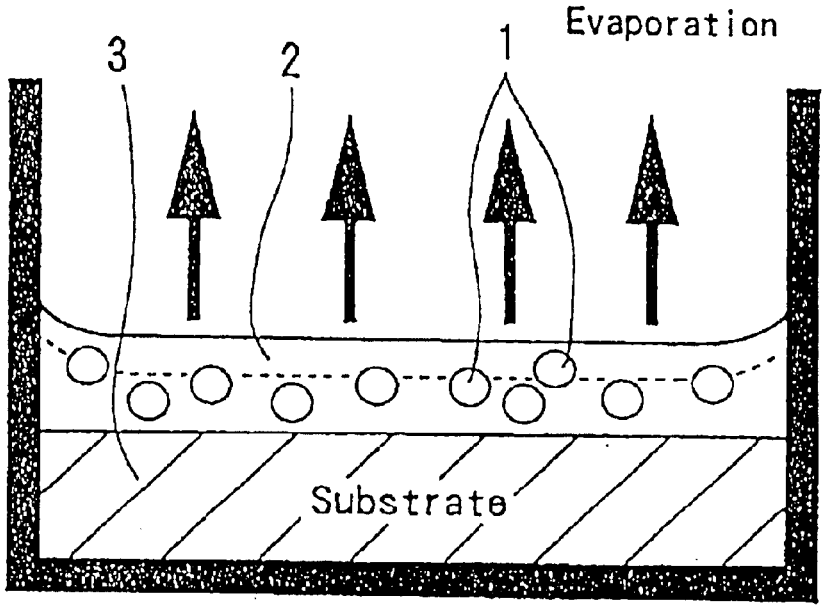
FIG. 18 shows an outline drawing illustrating an evaporation aspect of the thin film generation method of the present invention.
Figure 19:
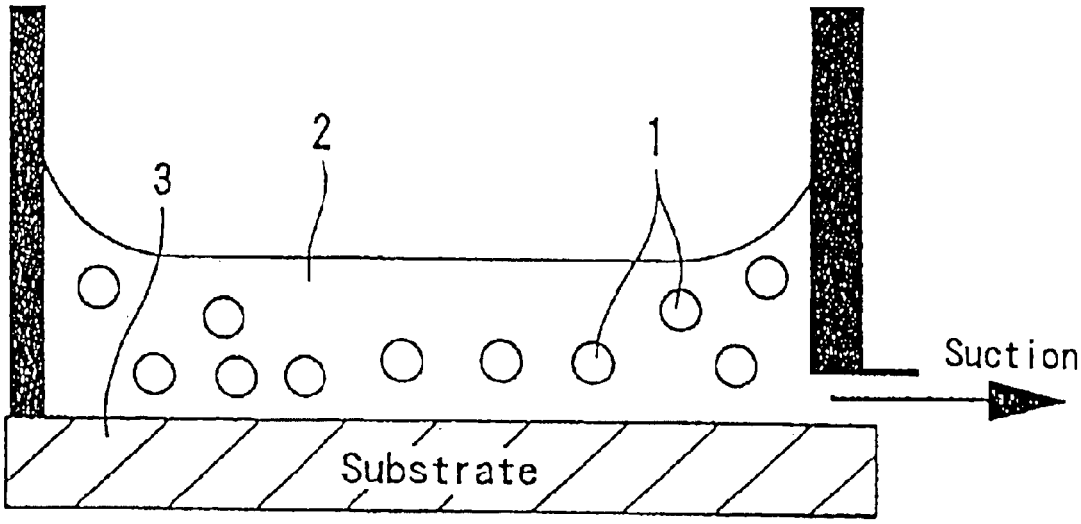
FIG. 19 shows an outline drawing illustrating a suction aspect of the thin film generation method of the present invention.
Figure 20:
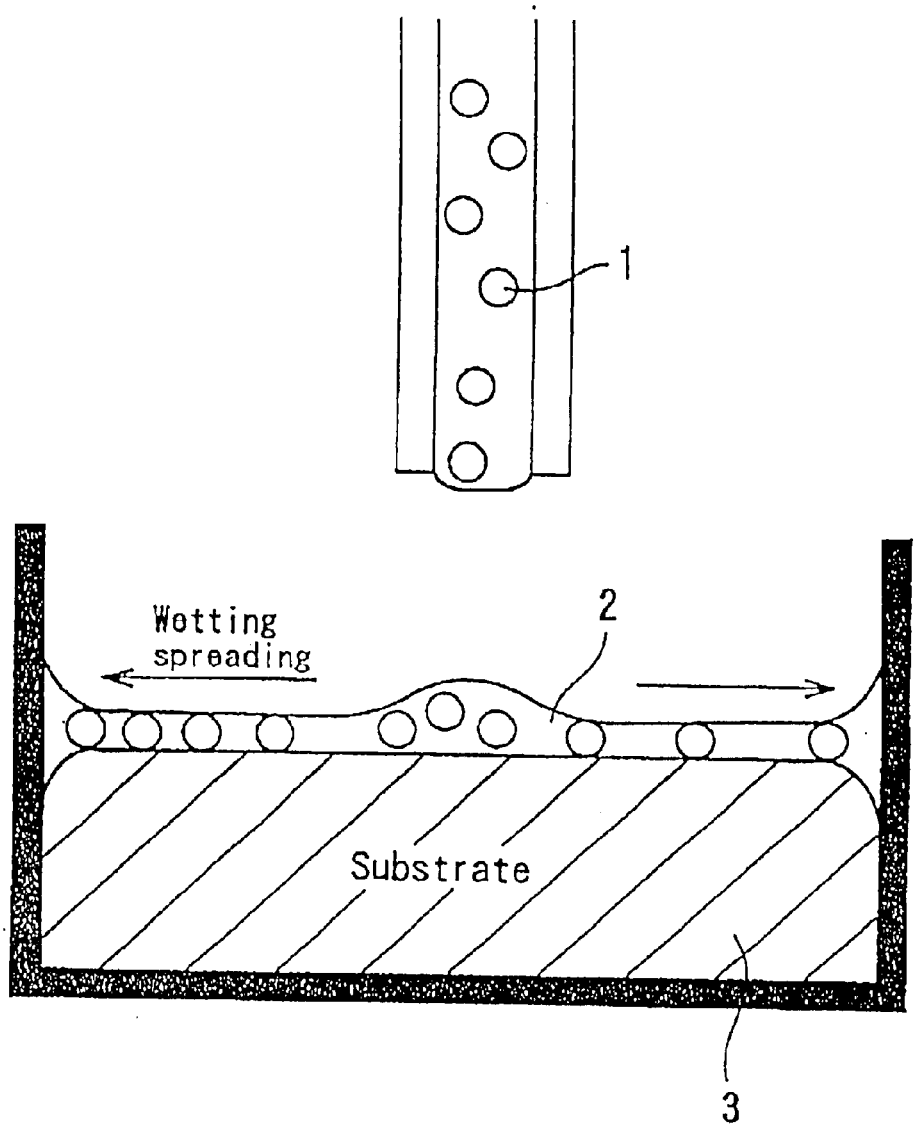
FIG. 20 shows an outline drawing illustrating another thin film generation method of the invention.

A stable wetting film is not formed when the surface of a substrate is not easily wetted. In this case, flow of the liquids and particles do not occur even when the liquid evaporates. The packing force deriving from strong lateral capillary force does not work either. For these reasons, a well aligned and clean crystallized particle film is not formed and only an irregular amorphous thin film is produced. FIG. 16 shows a thin 144 nm polystyrene suspension film which was spread, dried and solidified on a silver deposited mica plate (non-wettable).

Figure 15:
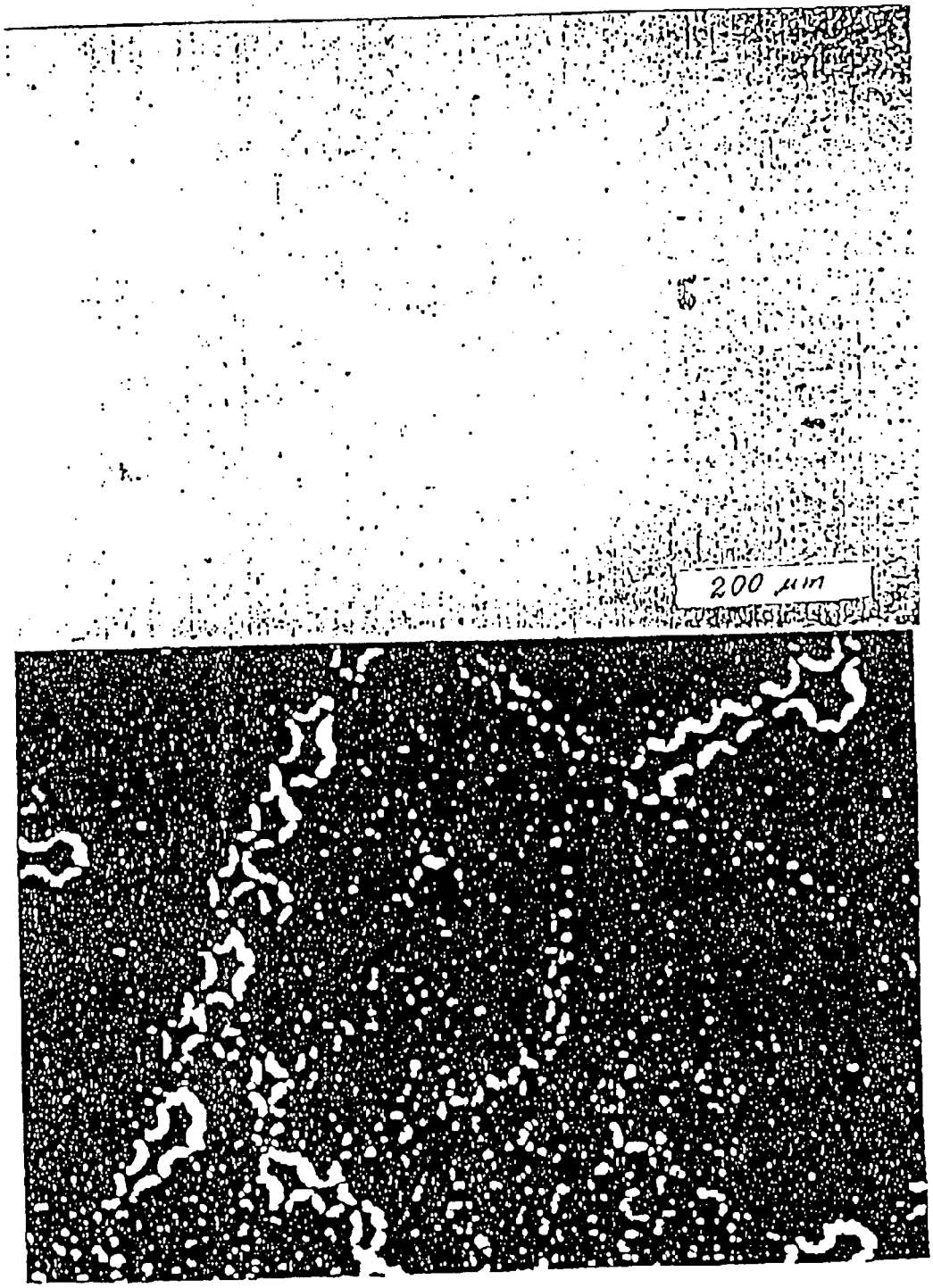
FIG. 15 shows a photograph as an embodiment of the present invention.

Comparison with FIG. 15(*b*) reveals nonuniform density, and local formation of 2- and 3-layered film. In this way, thin film of poor quality is produced when an unwettable substrate is used. This is often seen in a number of conventional classic dry-and-solidification methods.

We further measured the thickness of wetting film which is an important factor for particle film to gain a crystalline regularity in the initial growth period. Thickness of wetting film of water for the glass used was measured with an ellipsometer. The thickness was 150 to 170 nm in the horizontal position. This is sufficiently thin for polystyrene balls of 814 nm. It is thus expected that for these particles a complete crystallized film of a single layer is produced because of the balance between je and jp even in the horizontal state, provided the volume ratio is sufficient. Actually, formation of a relatively large crystallized particle film was observed on the periphery of wetting film of a high volume ratio even in the dry and solidification process which is close to a horizontal state.

In the case of 144 nm polystyrene balls, on the other hand, particle assembly does not proceed satisfactorily in the horizontal state. Formation of crystallized particle film was started only when the thickness of the wetting film was decreased, on the upper side, to approximately the particle size by inclining the substrate.

As described above in detail, the present invention affords a method to produce stable wetting film of a large area, control the number of layers of particle film, and supply particles, together enabling large-lot continuous production of dense particle film.

We claim:

1. A method of forming a particle film on a surface of a solid or liquid substrate comprising:

wetting the substrate, in the presence of a gas, with a liquid medium containing a plurality of particle suspended therein, thereby defining a concave liquid meniscus between the substrate and the gas, said liquid meniscus having an edge where the surface of the substrate and the liquid medium meet;

moving the edge of the liquid meniscus relative to the substrate, so that said particles in the liquid medium form said particle film on the surface of the substrate, wherein the density and thickness of said particle film are controlled by controlling: (i) the velocity of movement of the edge of the liquid meniscus relative to the substrate, (ii) the volume ratio of particles which is the ratio of the volume of said particles in the liquid medium to the volume of said particles and liquid in the liquid medium, and (iii) the rate of evaporation of liquid from the liquid medium, and permitting the liquid medium to evaporate;

said thickness of the particle film being controlled substantially according to the following relationship:

$$(1-\varepsilon)h = \beta \cdot l \cdot \frac{\phi}{1-\phi} \cdot je(Rh \cdot T)/Vc$$

wherein h represents said particle film thickness, ϵ represents the gap ratio of said particle film, B is a hydrodynamics coefficient representing friction between liquid and said particles in the liquid medium, l is a constant, ϕ represents said volume ratio of particles, je(Rh·T) represents said liquid evaporation rate, which depends on temperature (T) and relative humidity (Rh) in the gas, and Vc represents said velocity of the edge of the liquid meniscus.

2. The method as in claim 1, wherein the liquid medium containing said plurality of particles is provided in a reservoir, and said contacting is performed by immersing at least a portion of the substrate in the liquid medium.

3. The method as in claim 2, wherein said moving is performed by removing at least some of the liquid medium from the reservoir.

4. The method as in claim 1, wherein the liquid meniscus is defined by a barrier and the substrate, and said moving of the edge of the meniscus is performed by moving the barrier relative to the substrate.

5. The method as in claim 4, wherein said liquid meniscus is in fluid communication with a reservoir containing liquid medium and particles through an opening provided in said barrier.

6. The method as in claim 1, wherein the gas is air.

* * * * *